US010685630B2

(12) United States Patent
Moreira et al.

(10) Patent No.: US 10,685,630 B2
(45) Date of Patent: Jun. 16, 2020

(54) JUST-IN TIME SYSTEM BANDWIDTH CHANGES

(71) Applicant: QUALCOMM Incorporated, San Diego, CA (US)

(72) Inventors: Carlos Javier Moreira, Markham (CA); Paul Chow, Richmond Hill (CA); Dhaval Kanubhai Patel, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 28 days.

(21) Appl. No.: 16/004,327

(22) Filed: Jun. 8, 2018

(65) Prior Publication Data

US 2019/0378478 A1 Dec. 12, 2019

(51) Int. Cl.
*G09G 5/36* (2006.01)
*G09G 5/397* (2006.01)

(52) U.S. Cl.
CPC ..... *G09G 5/397* (2013.01); *G09G 2330/021* (2013.01); *G09G 2340/125* (2013.01); *G09G 2350/00* (2013.01); *G09G 2360/12* (2013.01); *G09G 2360/18* (2013.01)

(58) Field of Classification Search
CPC ..... G09G 2340/0435; G09G 2350/00; G09G 2360/18; G09G 5/005
See application file for complete search history.

(56) References Cited

U.S. PATENT DOCUMENTS 9,837,094 B2 12/2017 Subasingha et al.
2007/0057952 A1* 3/2007 Swedberg ..... G09G 5/00 345/474
2016/0330099 A1 11/2016 Koo et al.
2017/0064700 A1 3/2017 Cao et al.
2018/0063019 A1 3/2018 Martin

FOREIGN PATENT DOCUMENTS

WO 2017113336 A1 7/2017

* cited by examiner

*Primary Examiner* — Hau H Nguyen
(74) *Attorney, Agent, or Firm* — Muncy, Geissler, Olds & Lowe, P.C./Qualcomm

(57) ABSTRACT

According to various aspects, just-in-time system bandwidth changes may be implemented in hardware to optimize power consumption and performance in an electronic device. More particularly, in a periodic system associated with an electronic device, a bandwidth for a next frame may be configured during a current frame via software operating on the electronic device. Hardware associated with the periodic system may issue a bandwidth change request for the next frame when a current time reaches a bandwidth increase threshold in response to actual processing time associated with the current frame finishing prior to the bandwidth increase threshold, which may be defined relative to a timer deadline that defines when the next frame starts to process.

30 Claims, 12 Drawing Sheets

JUST-IN TIME SYSTEM BANDWIDTH CHANGES

TECHNICAL FIELD

The various aspects and embodiments described herein generally relate to hardware-implemented just-in-time system bandwidth changes to optimize power consumption and performance in an electronic device.

BACKGROUND

In an electronic device, one or more periodic systems may define frame boundaries or other time-dependent intervals in which certain processing tasks can have different resource requirements (e.g., bandwidth). For example, many electronic devices include a display processor that may be configured to blend multiple layers to compose a single image to be sent to a display and appropriately rendered within a given display frame. In that particular context, several different applications operating within the electronic device may send information to the display at any given time. For example, a system application may send a signal strength indicator to the display while a video application may send decoded video. In some cases, the same application may send multiple display items to the display at substantially the same time. The video application, for example, may send the decoded video plus a video counter and video control buttons. The video application may also send a decorative border that frames the decoded video. As another example, the system application may send the signal strength indicator plus a clock to the display. Each display item that the applications send to the display may comprise a separate display layer with a particular bandwidth requirement. For example, one of the display layers sent to the display may change at a high rate (e.g., decoded video that may change at a rate of approximately thirty (30) frames per second), while other display layers may change at a much lower rate or not at all. For example, time-of-day information and a video counter may change at a rate of approximately one (1) frame per second. Furthermore, in many cases, only small subsections of one or more display layers may change. The display processor may generally blend the various display layers to form a single image for the display and update the single image according to a bandwidth requirement of the fastest changing display layer. For example, if the decoded video changes at a rate of approximately 30 frames per second, the display processor may read in and blend all display layers at the rate of approximately 30 frames per second. As such, in a periodic system, bandwidth and/or other resource requirements may vary from one frame to another depending on the particular tasks to be performed in a given frame or other time-dependent interval.

In a periodic system such as a display processor configured to render data within defined time periods (often called "frames"), system bandwidth changes are conventionally handled completely in software. Consequently, in a conventional system, software bears the responsibility to ensure that the correct bandwidth is applied on time. This can potentially result in wasted power and degraded performance, however, as software is typically configured to handle system bandwidth changes conservatively due to software latencies and an inability to know the detailed hardware state. For example, when a next display frame requires more bandwidth than a current display frame, a software-controlled bandwidth increase for the next frame would be pre-emptively signaled early to ensure that the increase will be ready when the next frame begins. However, this results in wasted power because the bandwidth increase is applied earlier than actually required (i.e., during the current frame, which requires less bandwidth than the next frame). Furthermore, software-controlled bandwidth changes can also result in wasted power when the next frame requires less bandwidth than the current frame. For example, due to software latencies, software generally has to apply a bandwidth decrease pessimistically after the processing deadline for the current frame has expired to ensure that the current frame (which requires more bandwidth than the next frame) does not experience the decreased bandwidth. As such, power may be wasted during a portion of the next frame when the allocated bandwidth exceeds what is needed.

Accordingly, based on the foregoing, there is a need for mechanisms that may apply system bandwidth changes closer to the inter-frame/intra-frame deadline(s) used to demarcate when the change needs to be applied to optimize power and performance.

SUMMARY

The following presents a simplified summary relating to one or more aspects and/or embodiments disclosed herein. As such, the following summary should not be considered an extensive overview relating to all contemplated aspects and/or embodiments, nor should the following summary be regarded to identify key or critical elements relating to all contemplated aspects and/or embodiments or to delineate the scope associated with any particular aspect and/or embodiment. Accordingly, the following summary has the sole purpose to present certain concepts relating to one or more aspects and/or embodiments relating to the mechanisms disclosed herein in a simplified form to precede the detailed description presented below.

According to various aspects, a method for implementing just-in-time system bandwidth changes may comprise configuring, during a current frame in a periodic system associated with an electronic device, a bandwidth for a next frame, wherein the bandwidth for the next frame is configured via software operating on the electronic device, monitoring an actual processing time associated with the current frame, and issuing, via hardware associated with the periodic system, a bandwidth change request for the next frame when a current time reaches a bandwidth increase threshold in response to the actual processing time associated with the current frame finishing prior to the bandwidth increase threshold, wherein the bandwidth increase threshold is defined relative to a timer deadline that defines when the next frame starts to process.

According to various aspects, an electronic device may comprise a memory configured to store data and at least one processor configured to retrieve and process the data stored in the memory according to a periodic system, wherein the at least one processor may be further configured to configure, during a current frame in the periodic system, a bandwidth for a next frame via software executing on the at least one processor, monitor an actual processing time associated with the current frame, and issue, via hardware, a bandwidth change request for the next frame when a current time reaches a bandwidth increase threshold in response to the actual processing time associated with the current frame finishing prior to the bandwidth increase threshold, wherein the bandwidth increase threshold is defined relative to a timer deadline that defines when the next frame starts to process.

According to various aspects, an apparatus may comprise means for configuring, via software, a bandwidth for a next frame during a current frame in a periodic system associated with the apparatus, means for monitoring an actual processing time associated with the current frame, and means for issuing, via hardware associated with the periodic system, a bandwidth change request for the next frame when a current time reaches a bandwidth increase threshold in response to the actual processing time associated with the current frame finishing prior to the bandwidth increase threshold, wherein the bandwidth increase threshold is defined relative to a timer deadline that defines when the next frame starts to process.

According to various aspects, a computer-readable storage medium may have computer-executable instructions recorded thereon, wherein the computer-executable instructions may be configured to cause an electronic device to configure, during a current frame in a periodic system associated with the electronic device, a bandwidth for a next frame, wherein the bandwidth for the next frame is configured via software operating on the electronic device, monitor an actual processing time associated with the current frame, and issue, via hardware associated with the periodic system, a bandwidth change request for the next frame when a current time reaches a bandwidth increase threshold in response to the actual processing time associated with the current frame finishing prior to the bandwidth increase threshold, wherein the bandwidth increase threshold is defined relative to a timer deadline that defines when the next frame starts to process.

Other objects and advantages associated with the aspects and embodiments disclosed herein will be apparent to those skilled in the art based on the accompanying drawings and detailed description.

BRIEF DESCRIPTION OF THE DRAWINGS

A more complete appreciation of the various aspects and embodiments described herein and many attendant advantages thereof will be readily obtained as the same becomes better understood by reference to the following detailed description when considered in connection with the accompanying drawings which are presented solely for illustration and not limitation, and in which.

DETAILED DESCRIPTION

Figure 1:
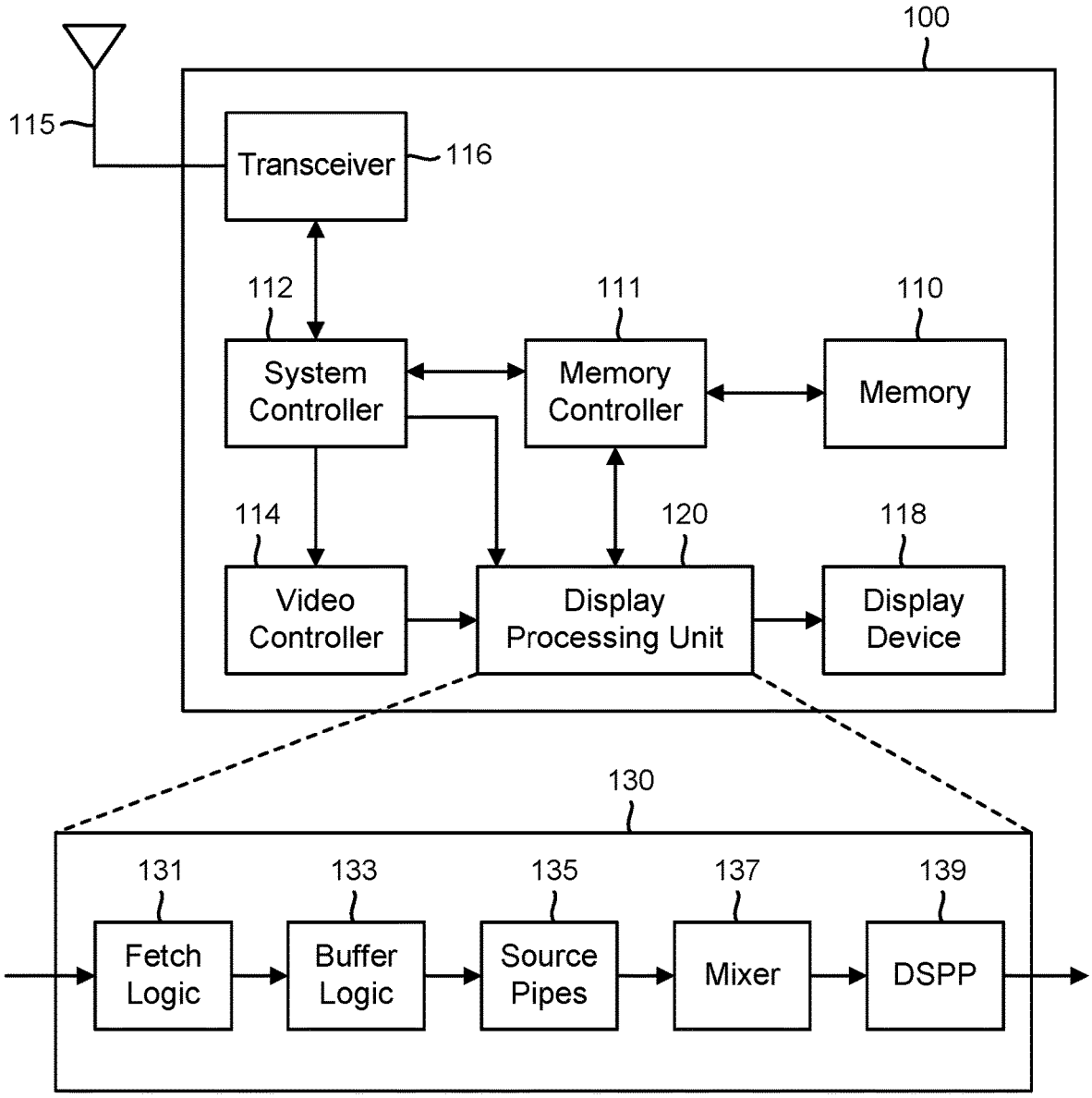
FIG. 1 illustrates an exemplary electronic device including a display processing unit (DPU) having hardware configured to implement just-in-time bandwidth changes to optimize power consumption and performance, according to various aspects.

Various aspects and embodiments are disclosed in the following description and related drawings to show specific examples relating to exemplary aspects and embodiments. Alternate aspects and embodiments will be apparent to those skilled in the pertinent art upon reading this disclosure, and may be constructed and practiced without departing from the scope or spirit of the disclosure. Additionally, well-known elements will not be described in detail or may be omitted so as to not obscure the relevant details of the aspects and embodiments disclosed herein.

The word "exemplary" is used herein to mean "serving as an example, instance, or illustration." Any embodiment described herein as "exemplary" is not necessarily to be construed as preferred or advantageous over other embodiments. Likewise, the term "embodiments" does not require that all embodiments include the discussed feature, advantage, or mode of operation.

The terminology used herein describes particular embodiments only and should not be construed to limit any embodiments disclosed herein. As used herein, the singular forms "a," "an," and "the" are intended to include the plural forms as well, unless the context clearly indicates otherwise. Those skilled in the art will further understand that the terms "comprises," "comprising," "includes," and/or "including," as used herein, specify the presence of stated features, integers, steps, operations, elements, and/or components, but do not preclude the presence or addition of one or more other features, integers, steps, operations, elements, components, and/or groups thereof.

Further, various aspects and/or embodiments may be described in terms of sequences of actions to be performed by, for example, elements of a computing device. Those skilled in the art will recognize that various actions described herein can be performed by specific circuits (e.g., an application specific integrated circuit (ASIC)), by program instructions being executed by one or more processors, or by a combination of both. Additionally, these sequences of actions described herein can be considered to be embodied entirely within any form of non-transitory computer-readable medium having stored thereon a corresponding set of computer instructions that upon execution would cause an associated processor to perform the functionality described herein. Thus, the various aspects described herein may be embodied in a number of different forms, all of which have been contemplated to be within the scope of the claimed subject matter. In addition, for each of the aspects described herein, the corresponding form of any such aspects may be described herein as, for example, "logic configured to" and/or other structural components configured to perform the described action.

As used herein, the terms "electronic device," "user device," "user equipment" (or "UE"), "user terminal," "client device," "communication device," "wireless device," "wireless communications device," "handheld device," "mobile device," "mobile terminal," "mobile station," "handset," "access terminal," "subscriber device," "subscriber terminal," "subscriber station," "terminal," and variants thereof may interchangeably refer to any suitable mobile or stationary device. Accordingly, the above-mentioned terms may suitably refer to any one or all of cellular telephones, smart phones, personal or mobile multimedia players, personal data assistants, laptop computers, personal computers, tablet computers, smart books, palm-top computers, wireless electronic mail receivers, multimedia Internet-enabled cellular telephones, wireless gaming controllers, and similar devices with a programmable processor, memory, and circuitry, as would be apparent to a person having ordinary skill in the art.

As used herein, the term "system bandwidth" and variants thereof may refer to a rate at which data (e.g., images) can be read from or stored into system memory, while the terms "required bandwidth," "bandwidth requirement," and variants thereof may generally refer to the rate required to retrieve certain data from the system memory in a timely manner based on one or more application-specific requirements or constraints. In various embodiments, memory as described herein can be either volatile or nonvolatile, or can include both volatile and nonvolatile memory. For example, by way of illustration, and not limitation, nonvolatile memory can include read only memory (ROM), programmable ROM (PROM), electrically programmable ROM (EPROM), electrically erasable PROM (EEPROM), or flash memory, while volatile memory can include random access memory (RAM), which acts as external cache memory. For example, by way of illustration and not limitation, RAM is available in many forms such as synchronous RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), and direct Rambus RAM (DRRAM), among others. In general, the system bandwidth with respect to a given memory may depend on various factors, such as a base clock frequency, a number of data transfers per clock cycle (e.g., two in the case of double data rate memory, which transfers data on rising and falling edges of a clock signal), a memory bus width, a number of interfaces, etc., as would be apparent to those skilled in the art.

According to various aspects, FIG. 1 illustrates an exemplary electronic device 100 including a display processing unit (DPU) 120 having hardware configured to implement just-in-time bandwidth changes to optimize power consumption and performance (e.g., bandwidth required to read one or more images from a memory 110 for display via a display device 118). In the example illustrated in FIG. 1, the display processing unit 120 may reside within the electronic device 100, which includes a transceiver 116 coupled to an antenna 115 and may therefore take the form of any of the various exemplary electronic devices mentioned above that are equipped with wireless communication capabilities. However, those skilled in the art will appreciate that the example shown in FIG. 1 is only intended to be illustrative and not limiting, whereby the display processing unit 120 may be suitably used in other electronic devices, including electronic devices that only have wired communication capabilities and/or electronic devices that do not have communication capabilities. Furthermore, in various embodiments, the display processing unit 120 may be implemented as a standalone integrated circuit or as a system on a chip (SoC), as part of the same integrated circuit as one or more other components of the electronic device 100, and/or any suitable combination thereof, as would be apparent to a person having ordinary skill in the art.

According to various aspects, in the example illustrated in FIG. 1, the electronic device 100 includes a system controller 112, a video application controller 114, a transceiver 116 coupled to an antenna 115, the display processing unit (DPU) 120, a display device 118, and a memory 110 coupled to the system controller 112 and the display processing unit 120 via a memory controller 111. Accordingly, the system controller 112 and the display processing unit 120 may connect to the memory controller 111 to read data from and/or write data into the memory 110, and the memory controller 111 may in turn connect to the memory 110 to service the data read/write requests received from the system controller 112 and/or the display processing unit 120. Furthermore, in various embodiments, the electronic device 100 may include a system bandwidth management block (not explicitly shown in FIG. 1), which may be a top-level resource management block configured to take bandwidth requests from any components that need to access the memory 110. The system bandwidth management block may sum up all the bandwidth requests and calculate an appropriate memory clock setting that would satisfy the total required memory bandwidth. As such, the system bandwidth management block may communicate the memory clock setting to the memory controller 111, which then adjusts a clock associated with the memory 110 accordingly to set the system bandwidth to the appropriate level.

In various embodiments, the system controller 112 may comprise a mobile station modem (MSM) that can control operation of the electronic device 100. The transceiver 116 may receive wireless signals from one or more base stations, access points, and/or other suitable devices via the antenna 115. The wireless signals may then be sent to the system controller 112 for processing and/or storage in the memory 110. For example, upon receiving a voice signal, the system controller 112 may immediately process the voice signal such that a user of the electronic device 100 may listen to the voice signal. As another example, upon receiving video data, the system controller 112 may store the video data in the memory 110 until the user of the electronic device 100 wants to view the video data. In other embodiments, the system controller 112 may receive video data from a video capture device, such as a camera or digital camcorder, included within the electronic device 100.

In various embodiments, the display device 118 may comprise a liquid crystal display (LCD), an organic light-emitting diode (OLED) display, a cathode ray tube (CRT) display, a plasma display, and/or any other suitable type of display device that may be known in the art. An image for presentation on the display device 118 may include multiple display layers from several different applications operating within the electronic device 100. For example, when the user of the electronic device 100 wants to view video, the system controller 112 may retrieve the stored video data from the memory 110 and send the video data to the video application controller 114. The video application controller 114 may then decode the video data and prepare the decoded video as a video display layer to be stored in the memory 110 such that the display processing unit 120 may retrieve the video display layer from the memory 110 and appropriately render the retrieved video display layer via the display device 118. Furthermore, in various embodiments, the video application controller 114 may also send a video counter and video control buttons as a video control display layer to be stored in the memory 110, and a decorative border that frames the decoded video as a border display layer to be stored in the memory 110. The system controller 112 may send a signal strength indicator, a network status indicator, a time and/or date, and/or other suitable data as a system status display layer to be stored in the memory 110. The user interface elements (e.g., video buttons, menus, etc.) may be rendered by a graphics processing unit (GPU) (not explicitly shown in FIG. 1) and also stored in the memory 110. Accordingly, because substantially all image data to be displayed is stored in the memory 110 and subsequently retrieved by the display processing unit 120 for ultimate rendering on the display device 118, the memory controller 111 may be configured to ensure that the memory 110 operates at an optimal frequency to satisfy the bandwidth required to properly display the image data on the display device 118.

According to various aspects, the one or more display layers that the display processing unit 120 retrieves from the memory 110 may have different bandwidth requirements, which may change from one frame to another. For example, video display layers from the video application controller 114 may include decoded data that is updated at a high frame rate and therefore has a high bandwidth requirement. For example, a typical display may operate at 60 frames per second, while super slow-motion video can currently operate at rates up to 960 frames per second, virtual reality (VR) and/or augmented reality (AR) displays typically operate at up to 120 frames per second, etc. The other display layers may change at lower rates or not at all. In some cases, only small sub-sections of one or more display layers may change. For example, a time clock included in the system status display layer and a video counter included in the video control display layer may change at a rate of one (1) frame per second. A date indication may only change once per day. A signal strength indicator included in the system status display layer may only change when the signal strength received by the electronic device 100 changes. In addition, video control buttons included in the video control display layer and a decorative border included in the border display layer may not change during display of the decoded video.

According to various aspects, as illustrated in FIG. 1, the display processing unit 120 may include a display subsystem pipeline 130 through which images received at the display processing unit 120 are processed for display at the display device 118. For example, as shown in FIG. 1, the display subsystem pipeline 130 may include fetch logic 131, buffer logic 133, one or more source surface processor pipes 135, a layer mixer 137, and a destination surface processor pipe (DSPP) 139. The display subsystem pipeline 130 may include additional modules or units not shown in FIG. 1 for purposes of clarity. For example, the display processing unit 120 may include one or more additional modules and/or units configured to perform hardware-accelerated image processing. Furthermore, the various modules and units shown in the display processing unit 120 may not be necessary in every example embodiment.

In various embodiments, the fetch logic 131 and the buffer logic 133 may respectively retrieve image data from an output buffer of the memory 110, the system controller 112, and/or the video application controller 114 and store the retrieved image data for further processing by other hardware units of the display processing unit 120. The source surface processor pipes 135 may receive one or more images from the buffer logic 133 and perform format conversion and quality improvement for source surfaces of videos and images. For example, the source surface processor pipes 135 may perform color space conversion, content adaptive contrast enhancement, flip operations, and the like on a received image and then output the processed image to the layer mixer 137.

The layer mixer 137 may receive the image from the source surface processor pipes 135 and perform blending and mixing of the image with one or more other surfaces. For example, the layer mixer 137 may perform alpha blending, color generation, setting of a transparency color key, blending of surfaces in arbitrary order, and blending in linear space. For example, the display processing unit 120 may retrieve or otherwise receive an image that is one frame of a video captured by one or more video sources (e.g., a camera). The layer mixer 137 may receive the image, mix the image with one or more additional graphical surfaces or images, and output the blended/mixed image to the DSPP 139, which may perform conversion, correction, and adjustments on the image received from the layer mixer 137 based on particular characteristics of the display device 118. For example, the DSPP 139 may perform operations for sunlight visibility improvement, content adaptive backlight scaling, panel color correction, gamma correction, dithering, picture adjustments, and the like. Once the DSPP 139 has completed its image operations on the image, the display processing unit 120 may output the processed image to the display device 118 via, for example, a display interface controller (not shown) for display by the display device 118.

Figure 2:
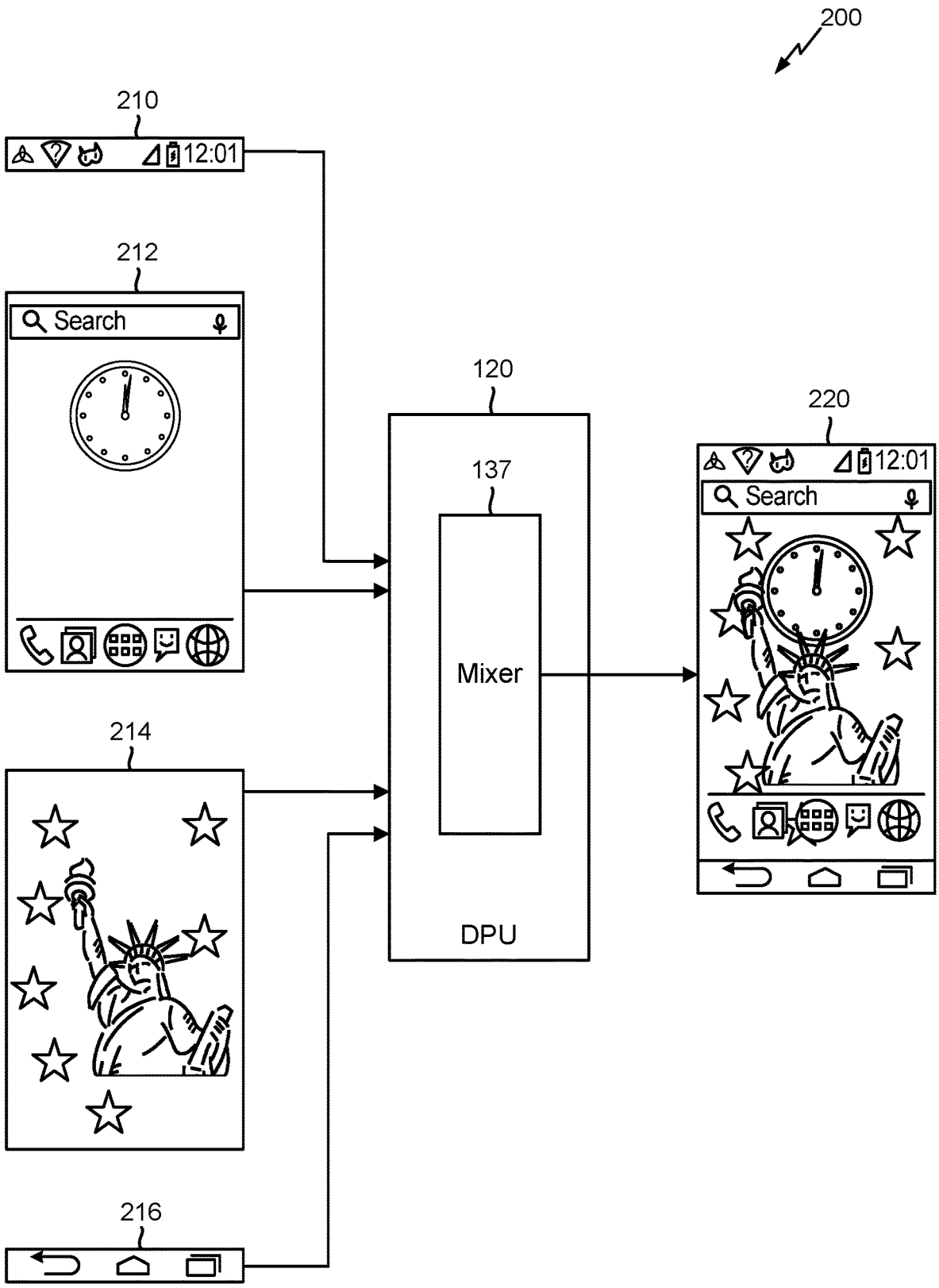
FIG. 2 illustrates an exemplary frame composition in which a panel comprises several layers with different bandwidth requirements, according to various aspects.

According to various aspects, as noted above, the one or more display layers that are received at the display processing unit 120 and processed through the display subsystem pipeline 130 may have different bandwidth requirements, which may change from one frame to another. For example, FIG. 2 illustrates an exemplary frame composition 200 in which several display layers are received at the display processing unit 120, which then uses the layer mixer 137 to blend, mix, or otherwise combine the several display layers into a single panel 220 to be output via the display device 118 (not explicitly shown in FIG. 2). For example, in FIG. 2, the several display layers that are received at the display processing unit 120 includes a status bar 210 that may show a received signal strength indicator, a carrier name, a battery level, a time, etc., a fullscreen application launcher 212 including a search bar, a clock, one or more applications, etc., a fullscreen wallpaper 214 (e.g., a static or dynamic image displayed on a home screen), and a navigation bar 216. The status bar 210, fullscreen application launcher 212, fullscreen wallpaper 214, and navigation bar 216 are thus blended, mixed, or otherwise combined into the single panel 220 to be output/rendered via the display device 118. As will be apparent to those skilled in the art, the various individual layers 210, 212, 214, 216 may have different bandwidth requirements, and moreover, the bandwidth needed to render the single panel 220 may vary from one frame to another depending on the particular input layers that are combined at the layer mixer 137 (e.g., the bandwidth that is required when a user is playing a game or watching a video may be substantially greater than the bandwidth that is required when the user is navigating a home screen, viewing text, etc.).

Figure 3A:
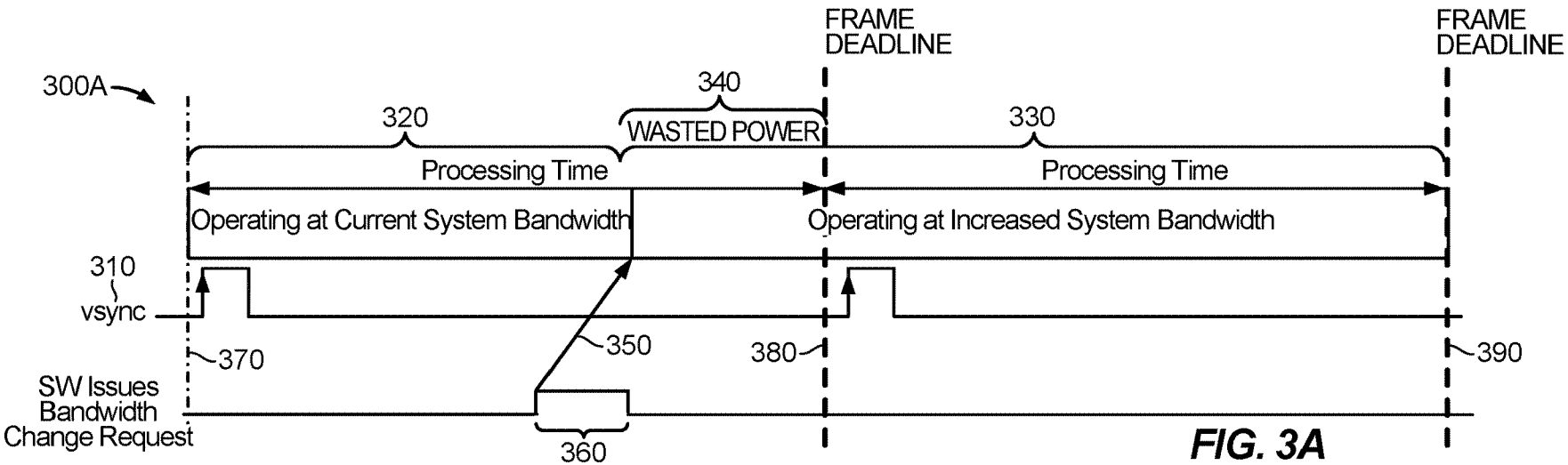
FIGS. 3A-3B illustrate timing diagrams of conventional approaches in which bandwidth changes are implemented entirely in software, according to various aspects.
Figure 3B:
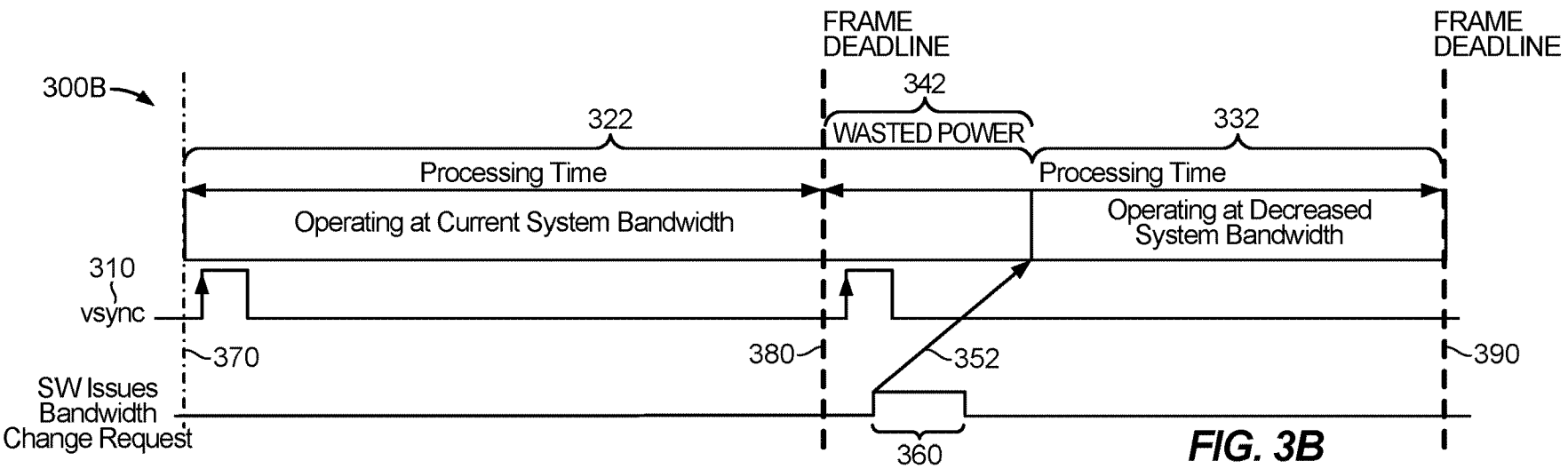

In general, as mentioned earlier, the conventional approach to handle system bandwidth changes in a periodic system (e.g., a display system as described above) is to have the bandwidth changes handled completely in software. For example, FIG. 3A illustrates an example timing diagram 300A of a conventional software-implemented approach to increase bandwidth for a next frame, while FIG. 3B illustrates an example timing diagram 300B of a conventional software-implemented approach to decrease the bandwidth for a next frame. More particularly, in FIGS. 3A-3B and the remainder of this disclosure, a display frame (or simply "frame") may be defined relative to a vsync signal 310, which generally refers to a pulse in a computing system used to synchronize certain events to a refresh cycle associated with a display device. As such, applications generally start to draw on a boundary associated with the vsync signal 310 and composition hardware and/or software can start to composite on boundaries of the vsync signal 310. This allows smooth application rendering (time based animation) synchronized by the periodicity of the vsync signal 310. Furthermore, frame deadlines 380, 390 may be defined shortly before the vsync signal 310, during which time one or more buffers may be prefilled and/or other suitable tasks are performed to ensure that the data is ready to render when drawing starts at the boundary of the vsync signal 310.

According to various aspects, the conventional software-implemented approach to increase a bandwidth for a next frame will now be described in more detail. More particularly, referring to FIG. 3A, a current frame processing time may start at time 370, which is just prior to a first boundary of the vsync signal 310 and may also correspond to the frame deadline for a prior frame. The current frame processing time may continue until the frame deadline 380, which may generally define the end of the processing time for the current frame and the start of the processing time for the next frame. Furthermore, as shown in FIG. 3A, the frame deadline 380 is a short time prior to a second boundary of the vsync signal 310 such that one or more buffers may be prefilled starting at the frame deadline 380 and drawing may immediately start when the second boundary of the vsync signal 310 occurs. As such, in addition to demarcating the current frame from the next frame, the frame deadline 380 may define the latest time at which the bandwidth for the next frame needs to be set.

Accordingly, because the next frame requires a bandwidth increase relative to the current frame, the conventional software-implemented approach shown in FIG. 3A may pre-emptively issue the bandwidth change request early, as depicted at 350, to ensure that the bandwidth increase takes effect in time for the next frame. In particular, the bandwidth increase may be pre-emptively issued early due to a software latency 360 (e.g., an amount of time that elapses before the bandwidth change request 350 becomes effective) as well as a lack of knowledge about the particular hardware state (e.g., how much time the underlying hardware requires to effectuate the bandwidth increase). Furthermore, even with a pre-emptive early request, the software-issued bandwidth change request may take effect too late. For example, in the case of a bandwidth increase, there is a need to guarantee that the bandwidth change request is acknowledged and takes effect prior to sending the next frame that requires the higher system bandwidth. If the software does not receive the acknowledgement before the frame deadline 380, then the next frame will be delayed by one (1) cycle of the vsync signal 310, which causes an undesirable visual effect and a reduction in frame rate.

Accordingly, as shown in FIG. 3A, the periodic system (e.g., display processing unit) may operate at a current system bandwidth (i.e., a required bandwidth for the current frame) for a first time period 320 and operate at an increased system bandwidth (i.e., a required bandwidth for the next frame) for a second time period 330, wherein the software-issued bandwidth change request is signaled early at 350 to ensure that the increase is ready in time for the next frame (e.g., no later than the frame deadline 380). However, as shown in FIG. 3A, issuing the bandwidth increase early results in wasted power during a time period 340 because the current frame does not require the bandwidth increase (i.e., the bandwidth increase is applied earlier than required).

Furthermore, there may also be wasted power in conventional software-implemented approaches to issue a bandwidth decrease, as shown in FIG. 3B. In this example, due to the software latency 360 and lack of knowledge about the underlying hardware state, the software-issued bandwidth decrease is pessimistically signaled after the frame deadline 380 has expired, as depicted at 352. In particular, the bandwidth decrease needs to be applied after the frame deadline 380 defining the processing deadline for the current frame to ensure that the current frame does not experience the decreased bandwidth, which would be unacceptable from a performance standpoint. Accordingly, in FIG. 3B, the periodic system may operate at a current system bandwidth for a first time period 322 and operate at a decreased system bandwidth for a second time period 332, wherein pessimistically issuing the bandwidth decrease request after the frame deadline 380 results in wasted power during a time period 342 because the next frame is operating at a higher bandwidth than required during time period 342.

Figure 4:
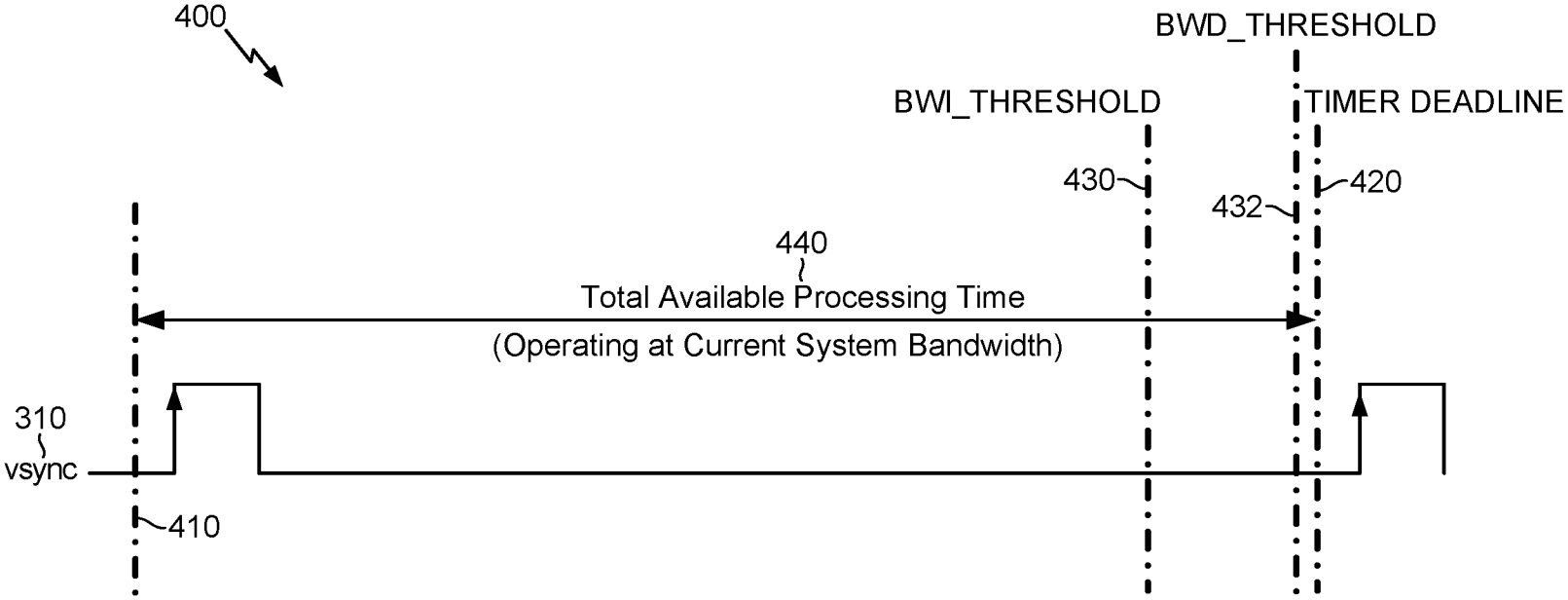
FIG. 4 illustrates an exemplary timing diagram corresponding to a frame in which various thresholds are defined to enable hardware-implemented just-in-time system bandwidth changes, according to various aspects.

Accordingly, to address at least the above-mentioned problems associated with conventional software-implemented approaches to signal bandwidth change requests, FIG. 4 illustrates an exemplary timing diagram 400 corresponding to a frame in which various thresholds are defined to enable hardware-implemented just-in-time system bandwidth changes. More particularly, as shown in FIG. 4, the current frame may have a start time 410 and a timer deadline 420, wherein the timer deadline 420 may be a hardware timer that defines when the next frame starts to process. As such, the start time 410 for the current frame may also be the timer deadline for a prior frame (not explicitly shown in FIG. 4), whereby the current frame may have a total available processing time 440 that runs from the start time 410 until the timer deadline 420. The timer deadline 420 that defines when the next frame starts to process may be reconfigurable on a frame-by-frame basis in either hardware, software, or a combination thereof.

Furthermore, according to various aspects, one or more programmable threshold regions may be defined relative to the timer deadline 420. For example, as shown in FIG. 4, a bandwidth increase threshold (BWI_THRESHOLD) 430 may be defined as the worst time required for a bandwidth increase to take effect plus a maximum latency to transfer bandwidth information from the DPU to a system bandwidth management block, which is a top-level resource management block that takes bandwidth requests from all the cores that need to access memory. The system bandwidth management block may sum up all the bandwidth requests from the cores that need to access memory and calculate the memory clock that would be required to satisfy the total memory bandwidth. Accordingly, the system bandwidth management block may communicate the clock requirement to the memory controller, which then adjusts the memory clock accordingly. Relatedly, a bandwidth decrease threshold (BWD_THRESHOLD) 432 may be defined as the maximum latency to transfer bandwidth information from the DPU to the system bandwidth management block. In various embodiments, using the above-defined threshold values 420, 430, 432 that are based on hardware capabilities, software may appropriately program or otherwise configure the bandwidth for the next frame at any time prior to the BWI_THRESHOLD 430 and the hardware may then determine precisely when to issue the bandwidth change request accordingly. In other words, the timer deadline 420 may essentially demarcate when the bandwidth for the next frame needs to be set, and the BWI_THRESHOLD 430 and BWD_THRESHOLD 432 define hardware trigger points for issuing bandwidth changes within frame timing, which allows bandwidth changes to be precisely enveloped while maximizing processing time and substantially reducing or eliminating software overhead.

Figure 5A:
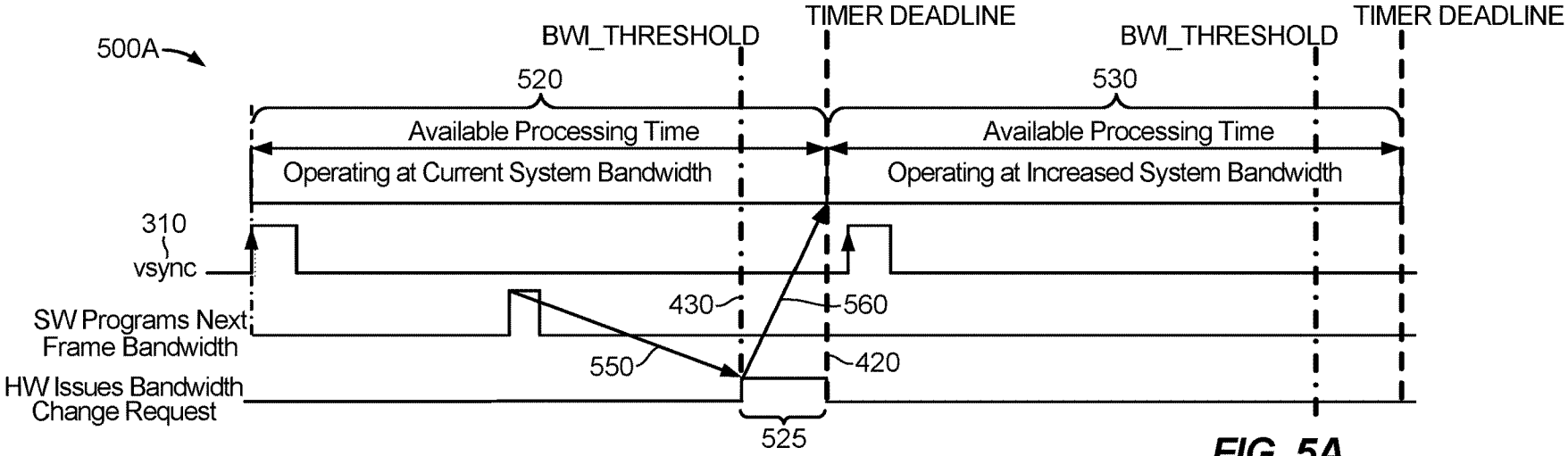
FIGS. 5A-5B illustrate timing diagrams of approaches in which hardware is configured to implement just-in-time system bandwidth changes using the threshold values defined in FIG. 4, according to various aspects.
Figure 5B:
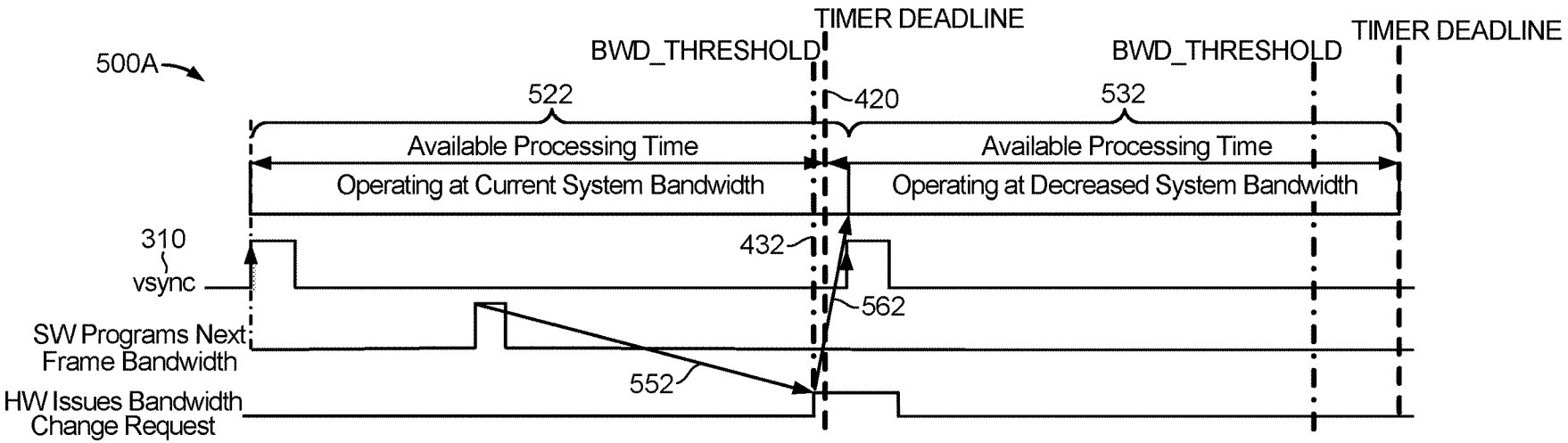

More particularly, according to various aspects, FIGS. 5A-5B illustrate timing diagrams of approaches in which hardware is configured to implement just-in-time system bandwidth changes using the threshold values defined in FIG. 4. For example, FIG. 5A illustrates a timing diagram 500A in which hardware is configured to implement a just-in-time bandwidth increase using the threshold values defined in FIG. 4, while FIG. 5B illustrates a timing diagram 500B in which the threshold values defined in FIG. 4 are used to implement a just-in-time bandwidth decrease. For clarity, FIG. 5A does not explicitly illustrate the BWD_THRESHOLD 432 and FIG. 5B does not explicitly illustrate the BWI_THRESHOLD 430. However, those skilled in the art will appreciate that the BWI_THRESHOLD 430 and the BWD_THRESHOLD 432 may be defined in both cases although not specifically involved in the timing associated with the signals that are used to effectuate the bandwidth changes in both use cases.

In various embodiments, referring to FIG. 5A, the timing diagram 500A illustrated therein demonstrates the use case in which the next frame may require a bandwidth increase relative to the current frame, and the timer deadline 420 may define when the next frame starts to process. Accordingly, at 550, software programs the bandwidth increase for the next frame, which causes the hardware to issue the bandwidth change request at the BWI_THRESHOLD 430, which has a latency 525 defined as the worst time required for the bandwidth increase to take effect plus a maximum latency to transfer bandwidth information to the appropriate system bandwidth management block. As depicted at 560, issuing the bandwidth change request at the BWI_THRESHOLD 430 results in the bandwidth increase taking effect no later than the timer deadline 420 that defines when the next frame starts to process. Accordingly, the current frame may operate at the current system bandwidth (e.g., the actual bandwidth that the current frame requires) for a time period 520 that substantially equals the available processing time for the current frame, as the bandwidth increase takes effect no later than the timer deadline 420 that defines when the next frame starts to process. Furthermore, because the bandwidth increase takes effect at substantially the same time as the timer deadline 420 that defines when the next frame starts to process, the next frame may operate at the increased system bandwidth for a time period 530 that substantially equals the available processing time for the next frame. As such, relative to the software-implemented approach shown in FIG. 3A, using the threshold values defined in FIG. 4 to issue a just-in-time system bandwidth increase may substantially eliminate the time period 340 during which power is wasted due to a software-implemented approach having to signal a bandwidth increase earlier than necessary.

In various embodiments, referring now to FIG. 5B, the timing diagram 500B illustrated therein demonstrates the use case in which the next frame may require a bandwidth decrease relative to the current frame, and the timer deadline 420 may define when the next frame starts to process. In the bandwidth decrease use case, however, the bandwidth decrease cannot take effect until after the current frame has finished. As such, in FIG. 5B, additional precautions need to be taken to ensure that the bandwidth decrease does not take effect during the actual processing time of the current frame to avoid an unacceptable performance penalty. Accordingly, at 552, software programs the bandwidth decrease for the next frame, which causes the hardware to issue the bandwidth change request at the BWD_THRESHOLD 432, which is defined as the maximum latency to transfer bandwidth information to the appropriate system bandwidth management block. As depicted at 562, issuing the bandwidth change request at the BWD_THRESHOLD 432 results in the bandwidth decrease taking effect after the timer deadline 420, which defines when the next frame starts to process its data. Notably, in FIG. 5B, the bandwidth decrease takes effect after the timer deadline 420 that defines when the next frame starts to process because the next frame can operate at a bandwidth that is higher than necessary but the current frame cannot operate at a bandwidth that is lower than necessary. As such, in FIG. 5B, the current frame may operate at the current system bandwidth (e.g., the elevated bandwidth that the current frame requires relative to the next frame) for a time period 522 that substantially equals an available processing time for the current frame plus an amount of time between the timer deadline 420 and a time when the bandwidth decrease takes effect. Furthermore, because the bandwidth decrease takes effect after the timer deadline 420, the next frame may operate at the decreased system bandwidth for a time period 532 that substantially equals the available processing time for the next frame except for the time between the timer deadline 420 and the time when the bandwidth decrease takes effect. Accordingly, relative to the software-implemented approach shown in FIG. 3B, using the threshold values defined in FIG. 4 to issue a just-in-time system bandwidth decrease may substantially reduce the time period 342 during which power is wasted due to a software-implemented approach having to pessimistically signal a bandwidth decrease after the previous processing deadline has expired.

Figure 6A:
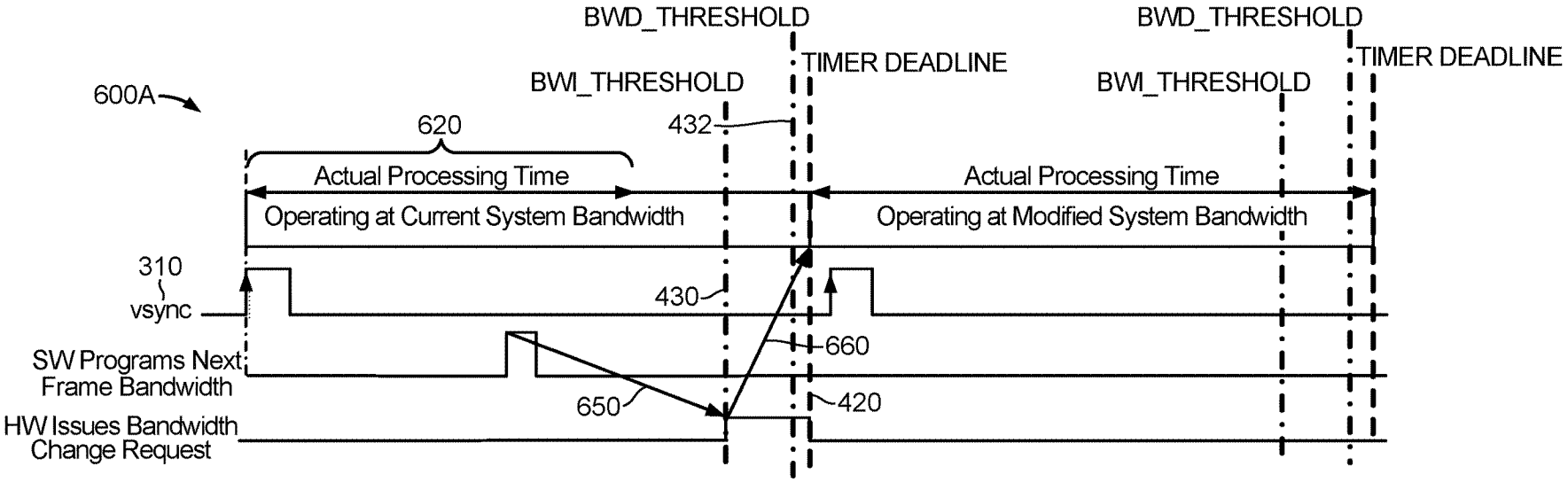
FIGS. 6A-6B illustrate timing diagrams of approaches in which hardware is configured to implement just-in-time system bandwidth changes when a current frame finishes processing before a bandwidth increase threshold, according to various aspects.
Figure 6B:
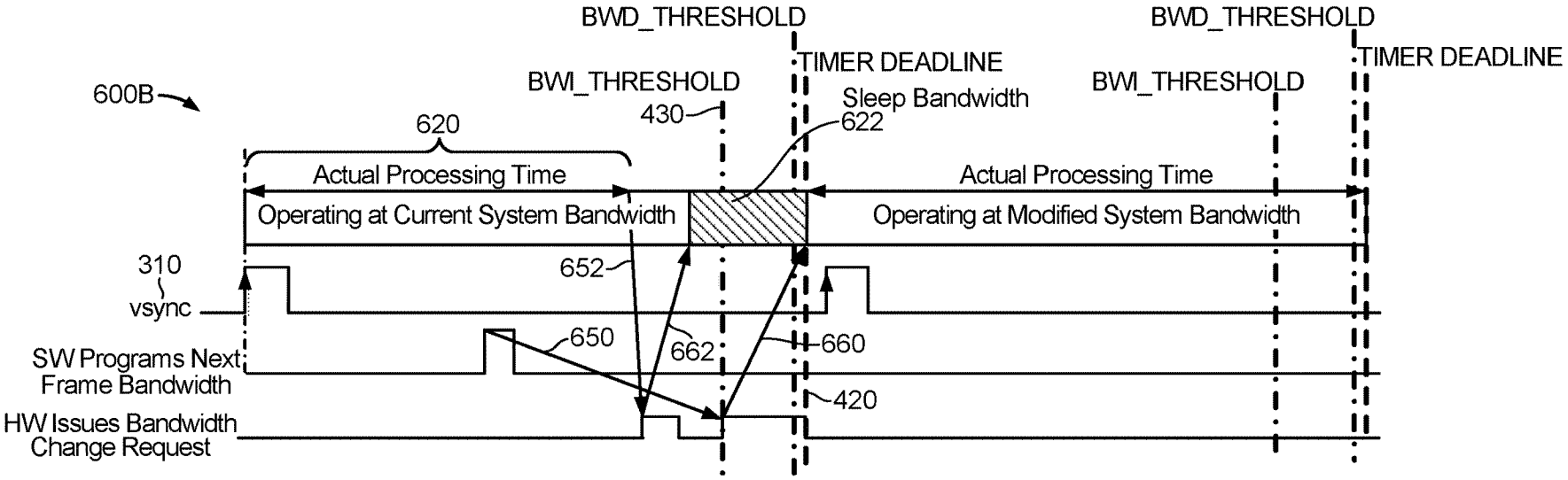

According to various aspects, FIGS. 6A-6B illustrate example timing diagrams 600A, 600B of approaches in which hardware is configured to implement just-in-time system bandwidth changes when a current frame finishes processing prior to the BWI_THRESHOLD 430 (e.g., as determined via a suitable hardware mechanism). As illustrated in FIG. 6A, when an actual processing time 620 for the current frame finishes before the BWI_THRESHOLD 430, there is sufficient time to issue precise on-time bandwidth changes for both increases and decreases. Accordingly, as depicted at 650, software configures the bandwidth that the next frame requires prior to BWI_THRESHOLD 430, and hardware then issues the bandwidth change request at 660 when current time reaches the BWI_THRESHOLD 430 regardless of whether the bandwidth change is an increase or a decrease. In other words, if the actual processing time 620 for the current frame finishes before the BWI_THRESHOLD 430, there may be no need to wait until the BWD_THRESHOLD 432 to issue a bandwidth decrease because an early decrease would not interfere with the actual processing time 620 for the current frame. Accordingly, when the current frame finishes prior to the BWI_THRESH- OLD 430, bandwidth increases and/or decreases relative to the current frame may be applied precisely when required by the next frame.

According to various aspects, FIG. 6B illustrates an example optimization that may be applied to further improve power consumption relative to the approach shown in FIG. 6A when the actual processing time 620 for the current frame finishes before the BWI_THRESHOLD 430. More particularly, in addition to issuing both bandwidth increases and bandwidth decreases for the next frame precisely when the current time reaches the BWI_THRESHOLD 430, the hardware may be configured to reduce system bandwidth during the idle time associated with the current frame to realize intra-frame system power savings in cases where the actual processing time 620 for the current frame finishes before the BWI_THRESHOLD 430. For example, as depicted at 652, an appropriate signal may be generated and provided to the hardware to indicate when the actual processing time 620 for the current frame has finished. At that time, as depicted at 662, the hardware may issue a bandwidth change request such that the system may operate at a sleep bandwidth 622 until the timer deadline 420 that defines when the next frame starts to process. Furthermore, as depicted at 650, the hardware may signal the bandwidth change request for the next frame at the BWI_THRESHOLD 430 so that the appropriate bandwidth is configured in time for the next frame. Notably, the optimization shown in FIG. 6B does not require any software intervention to take advantage of the idle time during the current frame. Instead, the hardware may trigger the sleep bandwidth 622 in cases where the actual processing time 620 is less than the BWI_THRESHOLD 430 and the software simply configures the bandwidth required for the next frame at any time prior to the BWI_THRESHOLD 430, as described above.

Figure 7A:
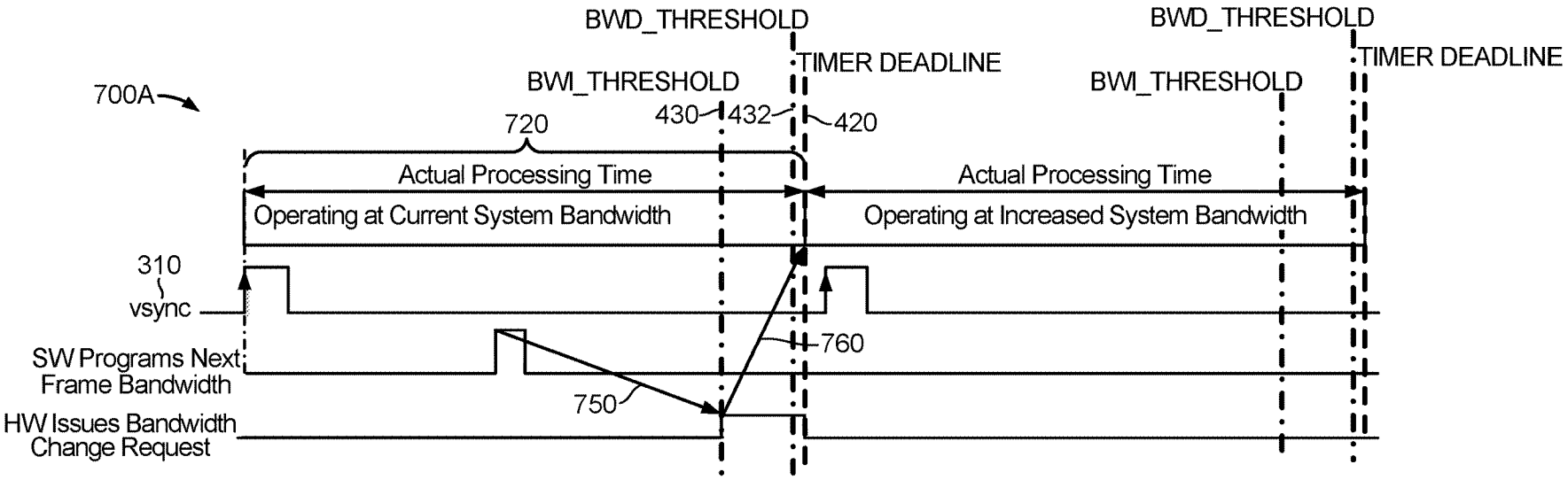
FIGS. 7A-7B illustrate timing diagrams of approaches in which hardware is configured to implement just-in-time system bandwidth changes when a current frame finishes processing after a bandwidth increase threshold, according to various aspects.
Figure 7B:
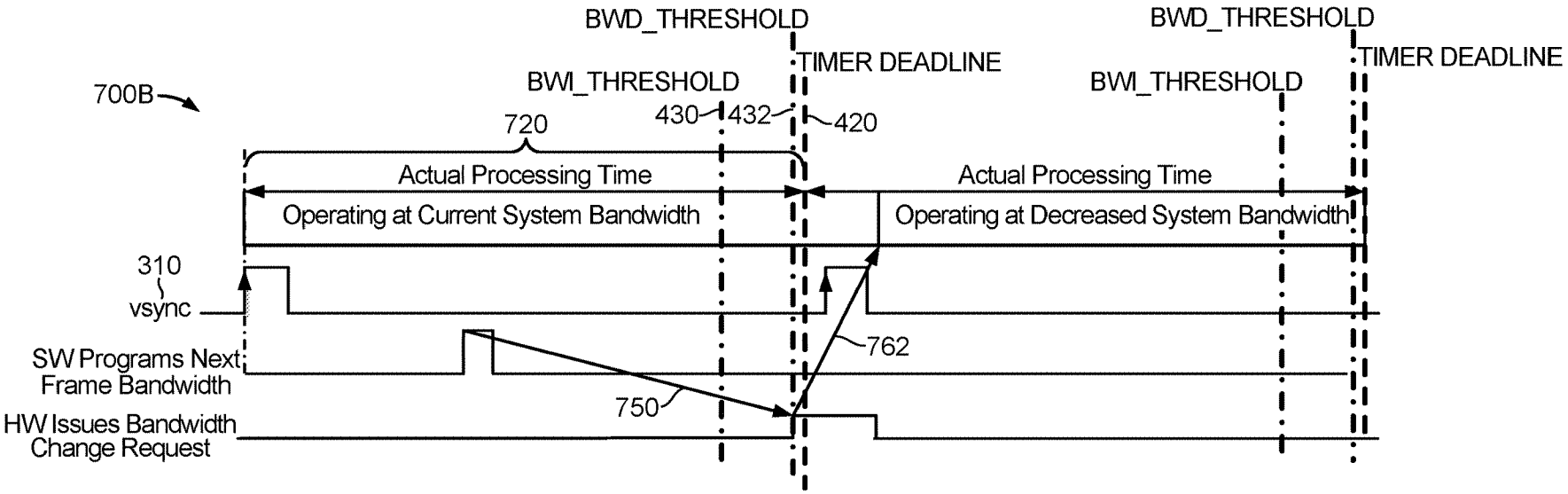

According to various aspects, FIGS. 7A-7B illustrate example timing diagrams 700A, 700B of approaches in which hardware is configured to implement just-in-time system bandwidth changes when the actual processing time for the current frame finishes after the BWI_THRESHOLD 430. In such cases, the appropriate bandwidth change request may be issued either concurrently with the current frame threshold times or after the current frame has finished processing, depending on context.

More particularly, with initial reference to FIG. 7A, the timing diagram 700A shown therein illustrates use cases in which the next frame requires a bandwidth increase relative to the current frame and an actual processing time 720 finishes after the BWI_THRESHOLD 430 has passed. The software may program the bandwidth for the next frame at 750 and the hardware may issue the bandwidth increase request at 760 when the current time reaches the BWI_THRESHOLD 430. In the case of a bandwidth increase, the hardware issues the bandwidth change request concurrently with the current frame to ensure that the bandwidth increase is correctly configured no later than the timer deadline 420 that defines the time when the next frame starts to process. As such, bandwidth increases may always be issued on time (i.e., at the BWI_THRESHOLD 430) because having the bandwidth increase take effect after the timer deadline 420 is unacceptable due to a potential adverse impact on the next frame processing.

Referring now to FIG. 7B, the timing diagram 700B shown therein illustrates use cases in which the next frame requires a bandwidth decrease relative to the current frame and the actual processing time 720 finishes after the BWI_THRESHOLD 430. As in the use cases described above, the software may program the bandwidth decrease for the next frame at 752. In this case, because the current frame requires more bandwidth than the next frame, the hardware may issue the bandwidth decrease request at 762 concurrently with the current frame when the current time reaches the BWD_THRESHOLD 432. Alternatively, in response to determining that the actual processing time 720 has finished at some point in time after the BWI_THRESHOLD 430 and prior to the BWD_THRESHOLD 432, the hardware may issue the bandwidth decrease request at that time. In either case, the bandwidth reduction will not take effect until after the next frame has started processing. In particular, while the bandwidth decrease has not taken effect when the next frame starts processing at the timer deadline 420, this is the earliest that a bandwidth decrease can be applied without negatively impacting the current frame that requires the higher bandwidth.

Figure 8:
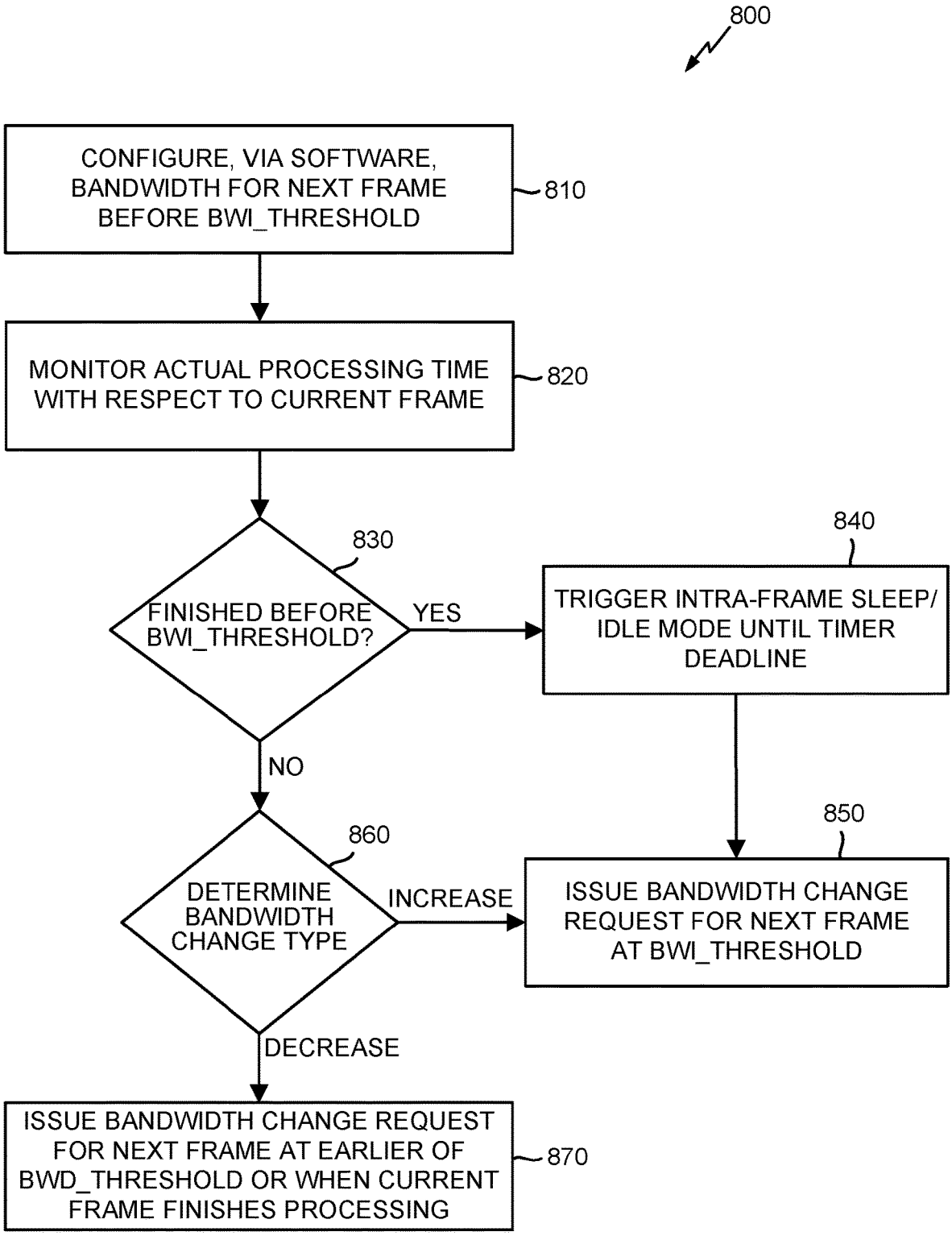
FIG. 8 illustrates an exemplary method for configuring hardware to implement just-in-time system bandwidth changes disclosed herein, according to various aspects.

According to various aspects FIG. 8 illustrates an exemplary method 800 for configuring hardware to implement just-in-time system bandwidth changes as disclosed herein. More particularly, at block 810, software may configure the bandwidth required for a next frame at any time prior to a bandwidth increase threshold defined as the worst time required for a bandwidth increase to take effect plus a maximum latency to transfer bandwidth information from a display processing unit (DPU) to a system bandwidth management block. In various embodiments, at block 820, actual processing time for the current frame may be monitored to determine whether and/or when the current frame has finished processing, as the time when the current frame finishes processing may impact when hardware issues the bandwidth change request that was configured at block 810. Accordingly, in response to determining at block 830 that the current frame has finished processing before the bandwidth increase threshold, the hardware may trigger an intra-frame sleep/idle mode at block 840 until current time reaches a timer deadline that defines when the next frame starts to process. Furthermore, once the current time reaches the bandwidth increase threshold, the hardware may issue the bandwidth change request at block 850, wherein the bandwidth change request that is issued at block 850 may be an increase or a decrease if the current frame has finished processing. Alternatively, in response to determining at block 830 that the current frame has not finished processing before the bandwidth increase threshold, the bandwidth change type (increase or decrease) may be determined at block 860. In response to determining that the bandwidth change is a bandwidth increase, the hardware may issue the bandwidth change request for the next frame at the bandwidth increase threshold in block 850. Otherwise, in response to determining that the bandwidth change is a bandwidth decrease, the hardware may issue the bandwidth change request for the next frame at a bandwidth decrease threshold in block 870, wherein the bandwidth decrease threshold may be defined as the maximum latency to transfer bandwidth information from the DPU to the system bandwidth management block.

Figure 9:
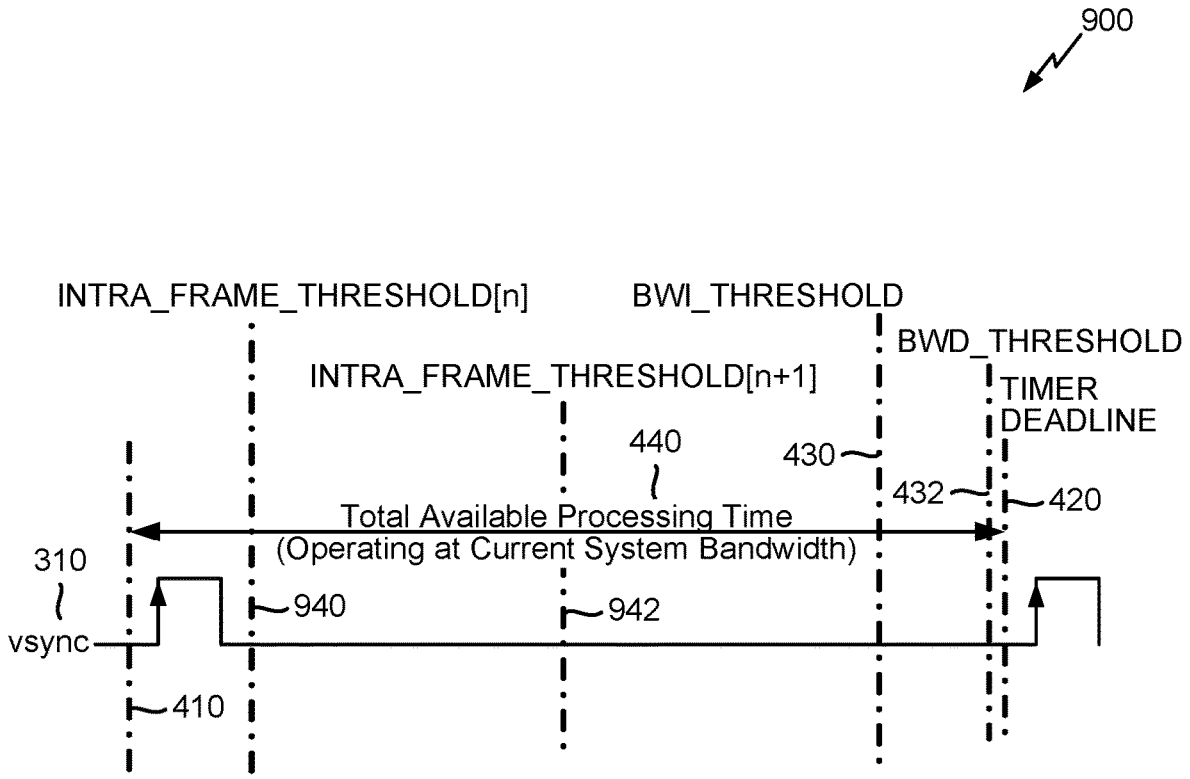
FIG. 9 illustrates an exemplary timing diagram corresponding to a frame in which one or more intra-frame threshold regions may enable hardware-implemented just-in-time intra-frame system bandwidth changes, according to various aspects.

According to various aspects, FIG. 9 illustrates an exemplary timing diagram 900 corresponding to a frame in which one or more intra-frame threshold regions 940, 942 are defined to enable hardware-implemented just-in-time intra-frame system bandwidth changes. More particularly, the timing diagram 900 illustrated in FIG. 9 may include the same threshold values 420, 430, 432 as defined in FIG. 4 plus the intra-frame threshold regions 940, 942 to further improve intra-frame performance and/or power consumption through just-in-time bandwidth changes within a given frame. In various embodiments, the intra-frame threshold regions 940, 942 may be defined relative to the timer deadline 420 that defines when the next frame starts to process. For example, software may configure or otherwise enable the intra-frame threshold regions 940, 942 at any time prior to the BWI_THRESHOLD 430 to allow intra-frame bandwidth changes due to potentially non-uniform bandwidth requirements during a given frame. In various embodiments, in context with FIG. 8, those skilled in the art will appreciate that the intra-frame threshold regions may be configured at block 810 as part of the procedure for configuring the bandwidth for the next frame. In general, there may be 'n' intra-frame threshold regions (e.g., two intra-frame threshold regions 940, 942 in the illustrated example), which may generally depend on the particular intra-frame tasks/requirements for the next frame. For example, in one embodiment, the intra-frame threshold regions 940, 942 may be configured to allow a bandwidth boost to start a frame while the rest of the frame can operate at a lower bandwidth (e.g., to boost performance to quickly fill one or more buffers during a possible prefill region before operating the rest of the frame at a different/reduced bandwidth to save power and/or improve performance). In another example use case, the intra-frame threshold regions 940, 942 may be configured to allow for a mid-frame bandwidth boost/reduction to handle non-uniform frame bandwidth requirements.

Figure 10:
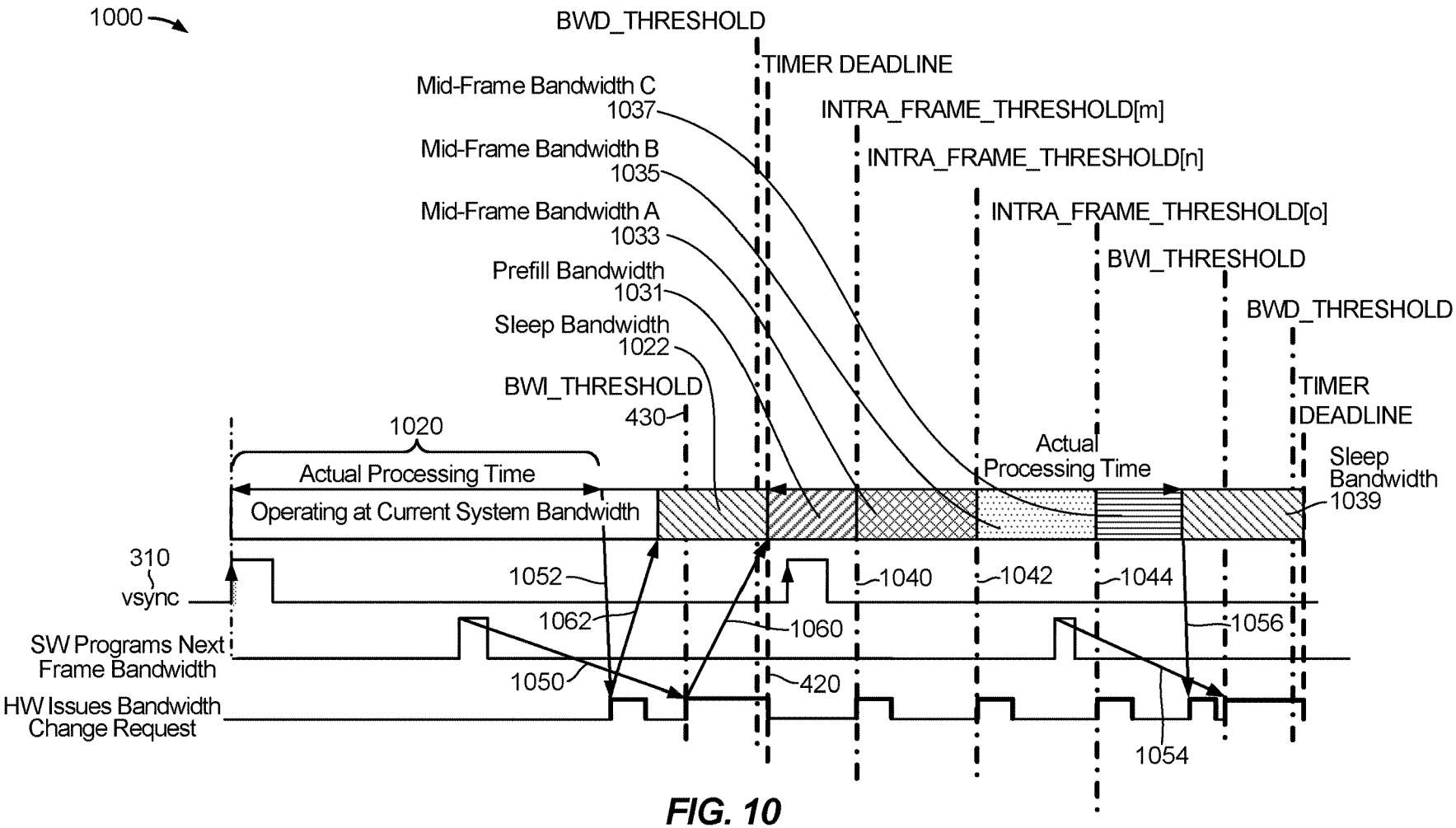
FIG. 10 illustrates a timing diagram of an approach in which hardware is configured to implement just-in-time intra-frame system bandwidth changes using the threshold values defined in FIG. 9, according to various aspects.

According to various aspects, FIG. 10 illustrates a timing diagram 1000 of an approach in which hardware is configured to implement just-in-time intra-frame system bandwidth changes using the threshold values defined in FIG. 9. Furthermore, the timing diagram 1000 may incorporate one or more approaches to implement just-in-time system bandwidth changes as described in further detail above. For example, FIG. 10 illustrates one example implementation in which the intra-frame threshold regions 940, 942 as shown in FIG. 9 may be combined with the optimization shown in FIG. 6B. However, those skilled in the art will appreciate that the intra-frame threshold regions 940, 942 shown in FIG. 9 may be suitably implemented in conjunction with any of the various use cases contemplated herein, which may include but are not limited to the use cases shown in FIG. 5A, FIG. 5B, FIG. 6A, FIG. 6B, FIG. 7A, and FIG. 7B.

Referring to FIG. 10, an actual processing time 1020 for a current frame may finish before a BWI_THRESHOLD 430 for the current frame, whereby the completion of the actual processing time 1020 may be signaled to hardware at 1052. As depicted at 1062, the hardware may then trigger an intra-frame sleep bandwidth 1022 to last until the timer deadline 420 that defines the time when the next frame starts to process. Furthermore, at some point in time prior to the BWI_THRESHOLD 430, software may configure the bandwidth for the next frame, as depicted at 1050. For example, in the illustrated example, software may configure a plurality of intra-frame thresholds 1040, 1042, 1044 for the next frame such that the hardware may automatically trigger the bandwidth changes at each intra-frame threshold 1040, 1042, 1044. Referring to FIG. 10, because the actual processing time 1020 finishes before the BWI_THRESHOLD 430, the hardware may issue the bandwidth change request to start the next frame when the current time reaches the BWI_THRESHOLD 430 regardless of whether the bandwidth to start the next frame is an increase or a decrease relative to the current frame, as depicted at 1060. In the illustrated example, the next frame starts with a prefill bandwidth region 1031 and the hardware then issues bandwidth change requests when the current time reaches each defined intra-frame threshold 1040, 1042, 1044, thus enabling various different mid-frame bandwidth regions 1033, 1035, 1037. As shown in FIG. 10, at 1054, software again configures the bandwidth for the subsequent frame at any time prior to the next BWI_THRESHOLD 430, wherein the subsequent frame bandwidth may be configured for the frame as a whole or for multiple intra-frame threshold regions that may have different bandwidths. In FIG. 10, the actual processing time for the next frame also finishes before the next BWI_THRESHOLD 430, whereby the hardware may be appropriately signaled at 1056 such that another intra-frame sleep bandwidth 1039 is triggered to last until the timer deadline 420 that defines the time when the subsequent frame starts to process.

Those skilled in the art will appreciate that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

Further, those skilled in the art will appreciate that the various illustrative logical blocks, modules, circuits, and algorithm steps described in connection with the aspects disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted to depart from the scope of the various aspects and embodiments described herein.

The various illustrative logical blocks, modules, and circuits described in connection with the aspects disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices (e.g., a combination of a DSP and a microprocessor, a plurality of microprocessors, one or more microprocessors in conjunction with a DSP core, or other such configurations).

The methods, sequences, and/or algorithms described in connection with the aspects disclosed herein may be embodied directly in hardware, in a software module executed by a processor, or in a combination of the two. A software module may reside in RAM, flash memory, ROM, EPROM, EEPROM, registers, hard disk, a removable disk, a CD-ROM, or any other form of non-transitory computer-readable medium known in the art. An exemplary non-transitory computer-readable medium may be coupled to the processor such that the processor can read information from, and write information to, the non-transitory computer-readable medium. In the alternative, the non-transitory computer-readable medium may be integral to the processor. The processor and the non-transitory computer-readable medium may reside in an ASIC. The ASIC may reside in an IoT device. In the alternative, the processor and the non-transitory computer-readable medium may be discrete components in a user terminal.

In one or more exemplary aspects, the functions described herein may be implemented in hardware, software, firmware, or any combination thereof. If implemented in software, the functions may be stored on or transmitted over as one or more instructions or code on a non-transitory computer-readable medium. Computer-readable media may include storage media and/or communication media including any non-transitory medium that may facilitate transferring a computer program from one place to another. A storage media may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Also, any connection is properly termed a computer-readable medium. For example, if the software is transmitted from a website, server, or other remote source using a coaxial cable, fiber optic cable, twisted pair, DSL, or wireless technologies such as infrared, radio, and microwave, then the coaxial cable, fiber optic cable, twisted pair, DSL, or wireless technologies such as infrared, radio, and microwave are included in the definition of a medium. The term disk and disc, which may be used interchangeably herein, includes CD, laser disc, optical disc, DVD, floppy disk, and Blu-ray discs, which usually reproduce data magnetically and/or optically with lasers. Combinations of the above should also be included within the scope of computer-readable media.

While the foregoing disclosure shows illustrative aspects and embodiments, those skilled in the art will appreciate that various changes and modifications could be made herein without departing from the scope of the disclosure as defined by the appended claims. Furthermore, in accordance with the various illustrative aspects and embodiments described herein, those skilled in the art will appreciate that the functions, steps, and/or actions in any methods described above and/or recited in any method claims appended hereto need not be performed in any particular order. Further still, to the extent that any elements are described above or recited in the appended claims in a singular form, those skilled in the art will appreciate that singular form(s) contemplate the plural as well unless limitation to the singular form(s) is explicitly stated.

What is claimed is:

1. A method for implementing just-in-time system bandwidth changes, comprising:

configuring, during a current frame in a periodic system associated with an electronic device, a bandwidth for a next frame, wherein the bandwidth is based on a rate at which data for the next frame is accessed from a memory, and the bandwidth for the next frame is configured via software operating on the electronic device;

monitoring an actual processing time associated with the current frame; and issuing, via hardware associated with the periodic system, a bandwidth change request for the next frame when a current time reaches a bandwidth increase threshold in response to the actual processing time associated with the current frame finishing prior to the bandwidth increase threshold, wherein the bandwidth increase threshold is defined relative to a timer deadline that defines when the next frame starts to process.

2. The method recited in claim 1, wherein the bandwidth change request causes the bandwidth for the next frame to increase relative to the current frame.

3. The method recited in claim 1, wherein the bandwidth change request causes the bandwidth for the next frame to decrease relative to the current frame.

4. The method recited in claim 1, wherein issuing the bandwidth change request when the current time reaches the bandwidth increase threshold causes the bandwidth change request to take effect no later than the timer deadline.

5. The method recited in claim 1, further comprising:

receiving, at the hardware associated with the periodic system, a signal indicating that the actual processing time associated with the current frame has finished prior to the bandwidth increase threshold; and triggering, via the hardware associated with the periodic system, an intra-frame sleep bandwidth during the current frame in response to the received signal, wherein the intra-frame sleep bandwidth is triggered to last until the timer deadline.

6. The method recited in claim 1, wherein the bandwidth increase threshold is defined as the worst time required for a bandwidth increase to take effect in the periodic system plus a maximum latency to transfer bandwidth information to a bandwidth management block in the periodic system.

7. The method recited in claim 6, further comprising:

determining that the actual processing time associated with the current frame has not finished by the bandwidth increase threshold; and issuing, via the hardware associated with the periodic system, the bandwidth change request for the next frame when the current time reaches the bandwidth increase threshold in response to the configured bandwidth for the next frame comprising a bandwidth increase relative to the current frame.

8. The method recited in claim 1, further comprising:

determining that the actual processing time associated with the current frame has not finished by the bandwidth increase threshold; and issuing, via the hardware associated with the periodic system, the bandwidth change request for the next frame when the current time reaches a bandwidth decrease threshold in response to the configured bandwidth for the next frame comprising a bandwidth decrease relative to the current frame.

9. The method recited in claim 8, wherein the bandwidth decrease threshold is defined as a maximum latency to transfer bandwidth information to a bandwidth management block in the periodic system.

10. The method recited in claim 8, wherein issuing the bandwidth change request when the current time reaches the bandwidth decrease threshold causes the bandwidth change request to take effect after the timer deadline.

11. The method recited in claim 1, wherein configuring the bandwidth for the next frame comprises defining one or more intra-frame threshold regions to enable one or more intra-frame bandwidth changes during the next frame.

12. The method recited in claim 11, further comprising:

issuing, via the hardware associated with the periodic system, bandwidth change requests at each of the one or more intra-frame threshold regions to enable the one or more intra-frame bandwidth changes during the next frame.

13. The method recited in claim 1, wherein the software configures the bandwidth for the next frame prior to the bandwidth increase threshold.

14. The method recited in claim 1, wherein the timer deadline is defined to occur prior to a boundary associated with a signal used to synchronize the periodic system.

15. An electronic device, comprising:

a memory configured to store data; and at least one processor configured to retrieve and process the data stored in the memory according to a periodic system, wherein the at least one processor is further configured to:

configure, during a current frame in the periodic system, a bandwidth for a next frame via software executing on the at least one processor, wherein the bandwidth is based on a rate at which data for the next frame is accessed in the memory;

monitor an actual processing time associated with the current frame; and issue, via hardware, a bandwidth change request for the next frame when a current time reaches a bandwidth increase threshold in response to the actual processing time associated with the current frame finishing prior to the bandwidth increase threshold, wherein the bandwidth increase threshold is defined relative to a timer deadline that defines when the next frame starts to process.

16. The electronic device recited in claim 15, wherein the bandwidth change request causes the bandwidth for the next frame to increase relative to the current frame.

17. The electronic device recited in claim 15, wherein the bandwidth change request causes the bandwidth for the next frame to decrease relative to the current frame.

18. The electronic device recited in claim 15, wherein the at least one processor is configured to issue the bandwidth change request when the current time reaches the bandwidth increase threshold such that the bandwidth change request takes effect no later than the timer deadline.

19. The electronic device recited in claim 15, wherein the at least one processor is further configured to:

receive a signal indicating that the actual processing time associated with the current frame has finished prior to the bandwidth increase threshold; and trigger an intra-frame sleep bandwidth during the current frame in response to the received signal, wherein the intra-frame sleep bandwidth is triggered to last until the timer deadline.

20. The electronic device recited in claim 15, wherein the bandwidth increase threshold is defined as the worst time required for a bandwidth increase to take effect in the periodic system plus a maximum latency to transfer bandwidth information to a bandwidth management block in the periodic system.

21. The electronic device recited in claim 20, wherein the at least one processor is further configured to:

determine that the actual processing time associated with the current frame has not finished by the bandwidth increase threshold; and issue, via the hardware, the bandwidth change request for the next frame when the current time reaches the bandwidth increase threshold in response to the configured bandwidth for the next frame comprising a bandwidth increase relative to the current frame.

22. The electronic device recited in claim 15, wherein the at least one processor is further configured to:

determine that the actual processing time associated with the current frame has not finished by the bandwidth increase threshold; and issue the bandwidth change request for the next frame when the current time reaches a bandwidth decrease threshold in response to the configured bandwidth for the next frame comprising a bandwidth decrease relative to the current frame.

23. The electronic device recited in claim 22, wherein the bandwidth decrease threshold is defined as a maximum latency to transfer bandwidth information to a bandwidth management block in the periodic system.

24. The electronic device recited in claim 22, wherein the at least one processor is configured to issue the bandwidth change request when the current time reaches the bandwidth decrease threshold such that the bandwidth change request takes effect after the timer deadline.

25. The electronic device recited in claim 15, wherein the at least one processor is further configured to define one or more intra-frame threshold regions to enable one or more intra-frame bandwidth changes during the next frame.

26. The electronic device recited in claim 25, wherein the at least one processor is further configured to issue, via the hardware, bandwidth change requests at each of the one or more intra-frame threshold regions to enable the one or more intra-frame bandwidth changes during the next frame.

27. The electronic device recited in claim 15, wherein the bandwidth for the next frame is configured prior to the bandwidth increase threshold.

28. The electronic device recited in claim 15, wherein the timer deadline is defined to occur prior to a boundary associated with a signal used to synchronize the periodic system.

29. An apparatus, comprising:

means for configuring, via software, a bandwidth for a next frame during a current frame in a periodic system associated with the apparatus, wherein the bandwidth is based on a rate at which data for the next frame is accessed in a memory;

means for monitoring an actual processing time associated with the current frame; and means for issuing, via hardware associated with the periodic system, a bandwidth change request for the next frame when a current time reaches a bandwidth increase threshold in response to the actual processing time associated with the current frame finishing prior to the bandwidth increase threshold, wherein the bandwidth increase threshold is defined relative to a timer deadline that defines when the next frame starts to process.

30. A computer-readable storage medium having computer-executable instructions recorded thereon, the computer-executable instructions configured to cause an electronic device to:

configure, during a current frame in a periodic system associated with the electronic device, a bandwidth for a next frame, wherein the bandwidth is based on a rate at which data for the next frame is accessed in a memory, and the bandwidth for the next frame is configured via software operating on the electronic device;

monitor an actual processing time associated with the current frame; and issue, via hardware associated with the periodic system, a bandwidth change request for the next frame when a current time reaches a bandwidth increase threshold in response to the actual processing time associated with the current frame finishing prior to the bandwidth increase threshold, wherein the bandwidth increase threshold is defined relative to a timer deadline that defines when the next frame starts to process.

* * * * *